US006727441B2

(12) United States Patent
Benda

(10) Patent No.: US 6,727,441 B2
(45) Date of Patent: Apr. 27, 2004

(54) SWITCH LEVER LOCK OUT ASSEMBLY

(75) Inventor: Steven J. Benda, Cokato, MN (US)

(73) Assignee: Brady Worldwide, Inc., Milwaukee, WI (US)

( * ) Notice: Subject to any disclaimer, the term of this patent is extended or adjusted under 35 U.S.C. 154(b) by 0 days.

(21) Appl. No.: 10/235,216

(22) Filed: Sep. 4, 2002

(65) Prior Publication Data

US 2004/0040824 A1 Mar. 4, 2004

(51) Int. Cl.[7] ..... H01H 9/28

(52) U.S. Cl. ..... 200/43.15; 200/43.11; 200/43.21

(58) Field of Search ..... 200/43.14, 43.15, 200/43.11, 43.08, 43.04, 43.19, 43.21, 43.22

(56) References Cited

U.S. PATENT DOCUMENTS

| | | | | |
|---|---|---|---|---|
| 2,169,860 A | | 8/1939 | Van Hoom | 70/203 |
| 2,937,248 A | | 5/1960 | Michetti | |
| 2,978,613 A | | 4/1961 | Hein | 317/119 |
| 3,109,899 A | | 11/1963 | Pastene | |
| 3,408,466 A | | 10/1968 | Palmer | |
| 3,629,529 A | | 12/1971 | Dietz | |
| 3,784,766 A | | 1/1974 | Johnson et al. | |
| 3,816,677 A | * | 6/1974 | Soltez | 200/43.11 |
| 4,006,324 A | | 2/1977 | Leasher et al. | |
| 4,300,030 A | | 11/1981 | Dimarco et al. | |
| 4,733,029 A | | 3/1988 | Kobayashi et al. | 200/43.15 |
| 5,148,910 A | | 9/1992 | Williams | 200/43.19 |
| 5,270,503 A | | 12/1993 | Frye | 200/43.14 |
| 5,300,740 A | | 4/1994 | Benda | 200/43.14 |
| 5,322,980 A | | 6/1994 | Benda | 200/43.014 |
| 5,412,167 A | * | 5/1995 | Mueller et al. | 200/43.14 |
| 5,500,495 A | | 3/1996 | Benda et al. | 200/43.14 |
| 5,593,020 A | | 1/1997 | Alexander | 200/43.14 |
| 5,648,646 A | | 7/1997 | Flegel | 200/50.32 |
| 5,732,815 A | | 3/1998 | Brouwer | 200/43.14 |
| 5,772,007 A | | 6/1998 | Frye | 200/43.14 |
| 5,794,760 A | | 8/1998 | Alexander | 200/43.14 |
| 5,900,600 A | | 5/1999 | Alexander et al. | 200/43.14 |
| 6,266,231 B1 | | 7/2001 | Donahue et al. | 361/631 |
| 6,396,008 B1 | | 5/2002 | Maloney et al. | 200/43.14 |
| 6,469,264 B2 | | 10/2002 | Benda | 200/43.14 |

FOREIGN PATENT DOCUMENTS

| | | |
|---|---|---|
| FR | 2424619 | 11/1979 |

* cited by examiner

*Primary Examiner*—Renee Luebke
(74) *Attorney, Agent, or Firm*—Quarles & Brady LLP

(57) ABSTRACT

A switch lever lock out assembly engagable with a switch. The assembly includes a lock out body engageable with a switch to prevent operation of the switch. A lever engaging member is mounted to the body, and has a lock position and an unlock position. In the lock position, the lever engaging member prevents disengaging the body from the switch. A blocking member is movably fixed to the body, and is engageable with the lever engaging member to prevent movement of the lever engaging member relative to the body when the lever engaging member is in the lock position. The blocking member is locked relative to the body by a key engageable mechanism. In another aspect of the invention, the key is fixed to a tether forming part of the assembly, and the key is lockable in a lock rail fixed within an area defined by the tether.

20 Claims, 13 Drawing Sheets

SWITCH LEVER LOCK OUT ASSEMBLY

CROSS REFERENCES TO RELATED APPLICATIONS

Not Applicable.

STATEMENT REGARDING FEDERALLY SPONSORED RESEARCH

Not Applicable

BACKGROUND OF THE INVENTION

The field of invention is switch lever lock outs for locking switch levers in a desired position, and more particularly to key operated switch lever lock outs.

Switches are used in many applications to control the flow of electrical energy. The switches can be used to redirect electrical energy from one circuit to another, and can be used to stop the flow of electrical energy through a circuit. In both cases the circuits become de-energized, that is without a voltage. One particular type of switch is a circuit breaker which cuts off the flow of electrical energy when the flow of electrical energy through the switch exceeds a predetermined value. Many of these circuit breakers include a lever which is movable between an "On" position and an "Off" position.

Maintenance personnel often use a circuit breaker to interrupt the flow of electrical energy through a circuit when the circuit, or electrical components connected thereto, require maintenance. The circuit breaker, however, is often remote from the location requiring maintenance. Therefore, it is desirable to lock out the circuit breaker to prevent an individual from inadvertently energizing the circuit while maintenance is being performed.

Known circuit breaker lock out assemblies engage the circuit breaker lever to prevent unauthorized movement of the lever. Lock outs, such as disclosed in U.S. Pat. Nos. 5,593,020; 5,794,760; and 5,900,600, include a lock arm cantilevered from a lock rail. The lock arm includes a head which engages or covers the circuit breaker lever to prevent unauthorized movement of the lever. This particular type of lock out requires the lock rail be positioned adjacent the specific circuit breaker being locked out. If there is insufficient space adjacent the specific circuit breaker for a lock rail, these lock outs cannot be used. Therefore, a need exists for an improved lock out which can be used with or without a lock rail, and if a lock rail is used, the lock rail can be located remote from the specific circuit breaker being locked out.

BRIEF SUMMARY OF THE INVENTION

The present invention provides a switch lever lock out assembly engagable with a switch. The assembly includes a lock out body engageable with a switch to prevent operation of the switch. A lever engaging member is mounted to the body, and has a lock position and an unlock position. In the lock position, the lever engaging member prevents disengaging the body from the switch. A blocking member is movably fixed to the body, and is engageable with the lever engaging member to prevent movement of the lever engaging member relative to the body when the lever engaging member is in the lock position.

The blocking member and body can be locked relative to each other by a latch member engaging a latching member. The latch member is fixed relative to one of the body and the blocking member. The latching member is engagable with the latch member in an engaged position, and fixed relative to the other of the body and the blocking member, wherein in the engaged position, the blocking member is locked relative to the lever engaging member in the lock position. A key is engageable with at least one of the latch member and the latching member to disengage the latching member from the latch member and allow the blocking member to move relative to the body to allow the lever engaging member to move from the lock position to the unlock position.

In another aspect of the invention, the key is attached to a tether forming part of the assembly. The tether has a first end and a second end, and the key is slidably fixed to the tether for slidable movement between said first and second ends. The key can be locked in a lock rail fixed within an area defined by the tether either inside or outside the circuit breaker enclosure.

A general objective of the present invention is to provide a lock out assembly which prevents unauthorized actuation of a switch. The present invention provides a lock out assembly which requires a key to disengage the assembly from the switch to allow operation of the switch.

Another objective of the present invention is to provide a lock out assembly which can be used with a lock rail which does not require aligning the lock rail with the switch being locked out. This objective is accomplished by providing a lock out assembly requiring a key, and fixing the key onto a tether, wherein the key is locked to the lock rail fixed within an area defined by the tether.

The foregoing and other objects and advantages of the invention will appear from the following description. In the description, reference is made to the accompanying drawings which form a part hereof, and in which there is shown by way of illustration a preferred embodiment of the invention.

DETAILED DESCRIPTION OF THE PREFERRED EMBODIMENTS

Figure 1:
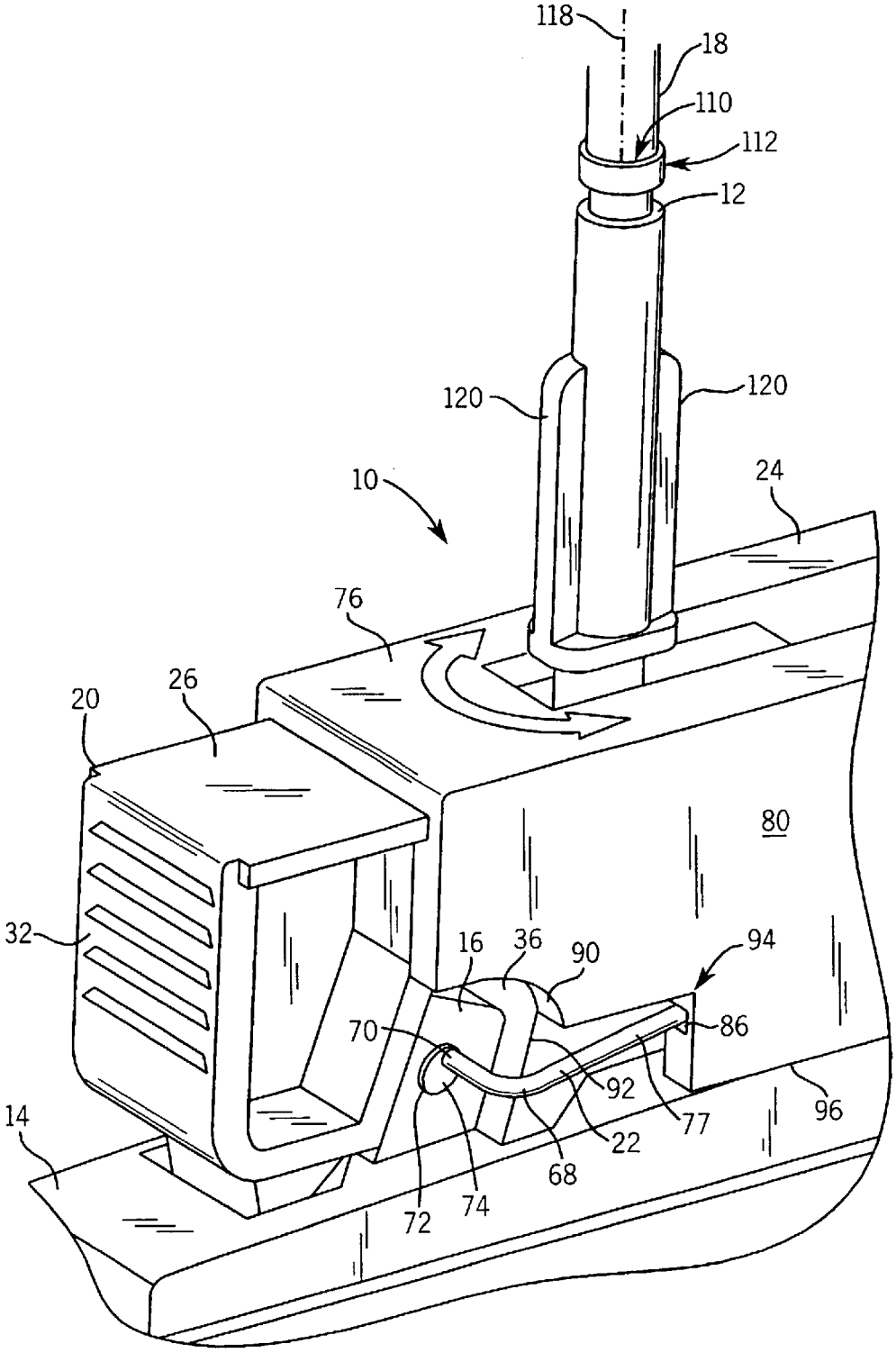
FIG. 1 is a perspective view of a circuit breaker lock out assembly incorporating the present invention.
Figure 2:
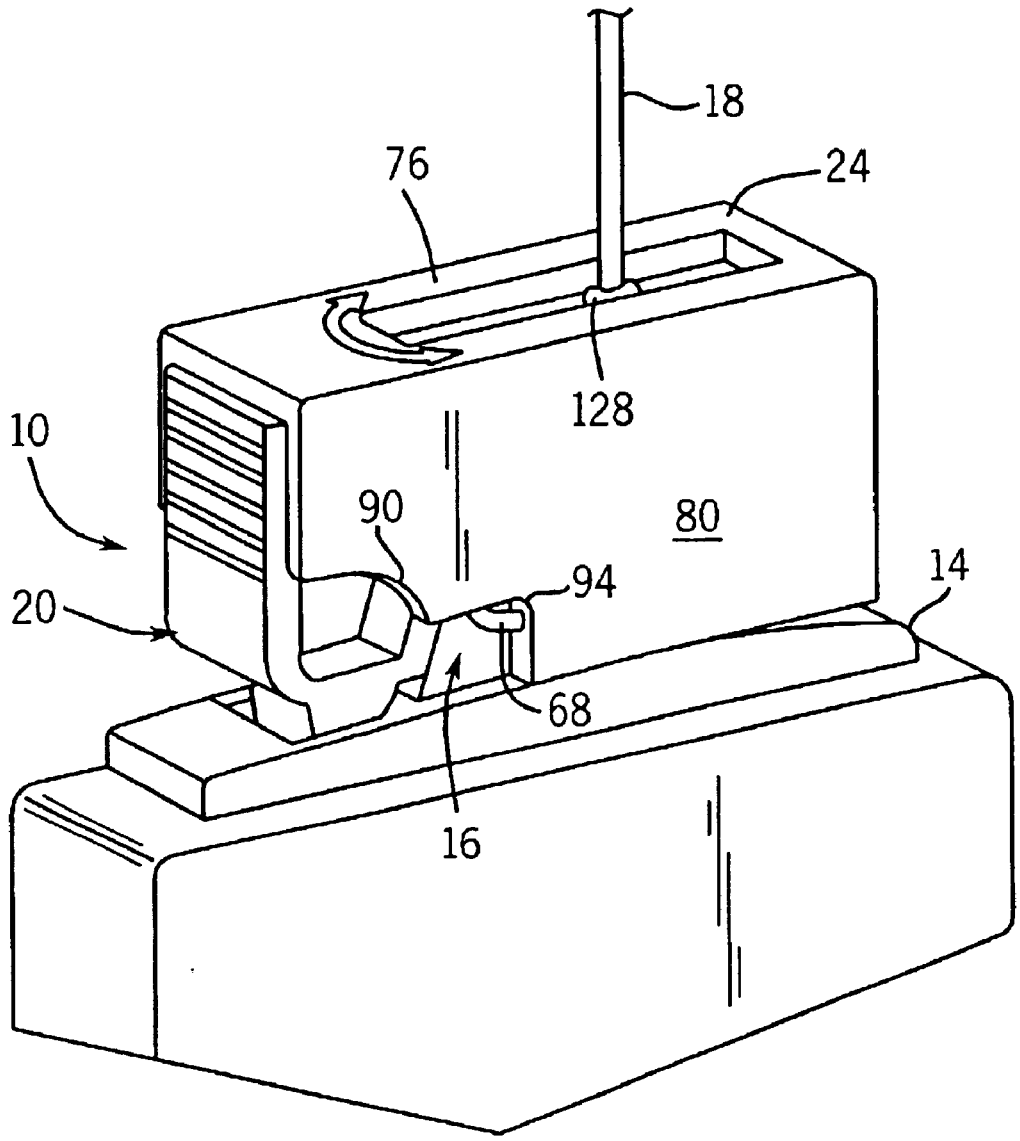
FIG. 2 is a perspective view of the lock out assembly of FIG. 1 with the blocking member in the lock position.

Referring to FIGS. 1–10, a switch lever lock out assembly 10 engages at least one circuit breaker 14 to prevent circuit breaker operation. The circuit breaker 14 includes a lever 16 movable between an "On" position and an "Off" position. The lock out assembly 10 engages the lever 16, and prevents movement of the lever 16 between the "On" position and "Off" position. A key 12 is required to disengage the lock out assembly 10 from the lever 16. The key 12 can be connected to the lock out assembly 10 by a tether 18 which can be locked to a lock rail 21 (shown in FIGS. 9 and 10) to prevent unauthorized use of the key 12, and thus unauthorized disengagement of the lock out assembly 10 from the lever 16. Advantageously, the lock rail 21 can be positioned anywhere within reach of the tether 18 regardless of the location of the lever 16.

The circuit breaker 14 can be any commercially available circuit breaker 14 having a lever 16 movable between two or more positions. Although, locking out a circuit breaker is disclosed herein, the present invention can be used to lock out any switch having a lever movable between two or more positions.

The circuit breaker lock out assembly 10 includes a body 20 which slips over the lever 16. A lever engaging member 22 fixed relative to the body 20 engages the lever 16 such that the lock out assembly 10 cannot be lifted away from the circuit breaker 14 and allow undesired movement of the lever 16. A blocking member 24 is slidably fixed to the body 20, and is slidably moveable between an unlocked position (shown in FIG. 1) and a locked position (shown in FIG. 2). In the locked position, the blocking member 24 prevents disengagement of the lever engaging member 22 from the lever 16, and thus, unauthorized removal of the lock out assembly 10 from the lever 16.

Figure 3:
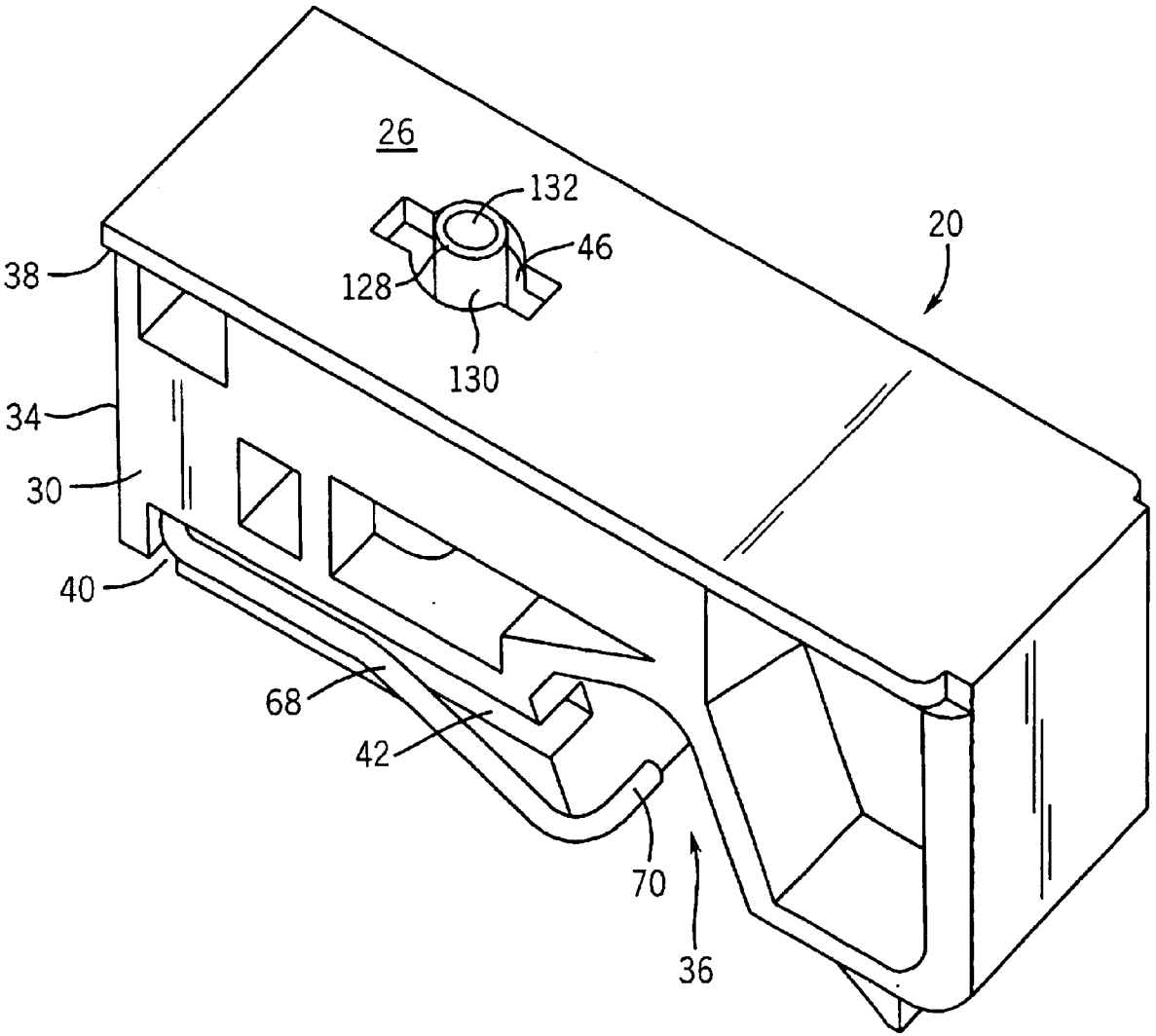
FIG. 3 is a top perspective view of the lock out assembly body of FIG. 1.
Figure 4:
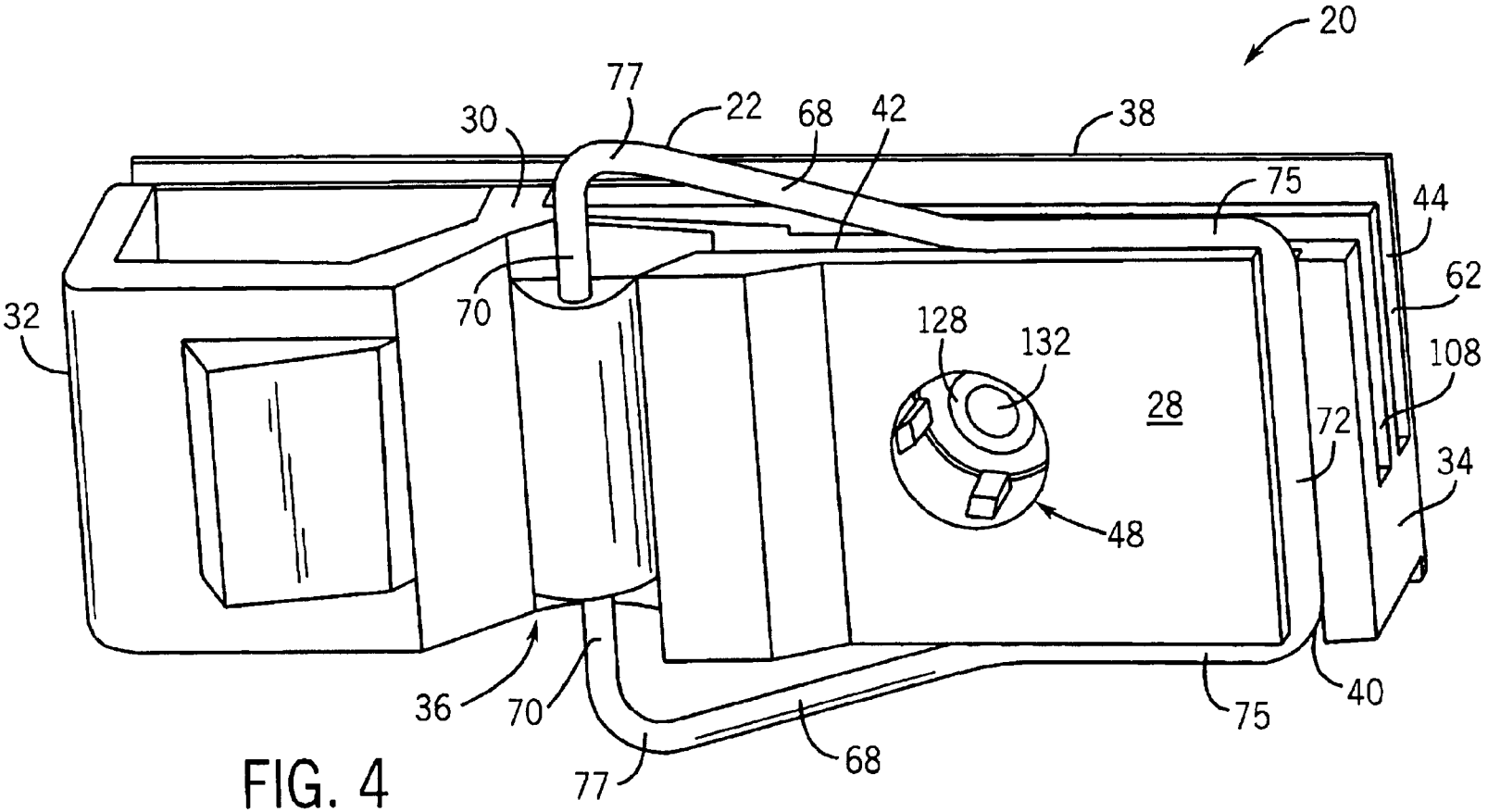
FIG. 4 is a bottom perspective view of the lock out assembly body of FIG. 1.
Figure 5:
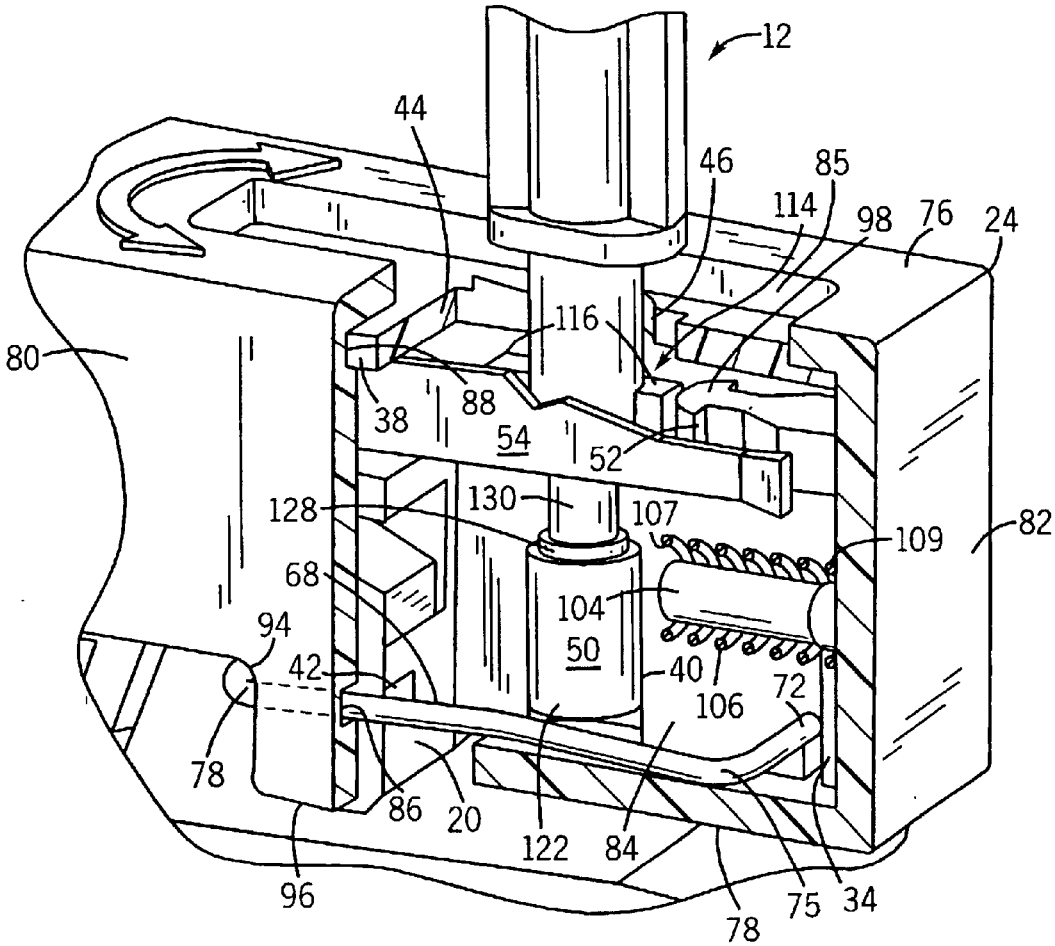
FIG. 5 is a cut away, rear perspective view of the lock out assembly of FIG. 1.
Figure 6:
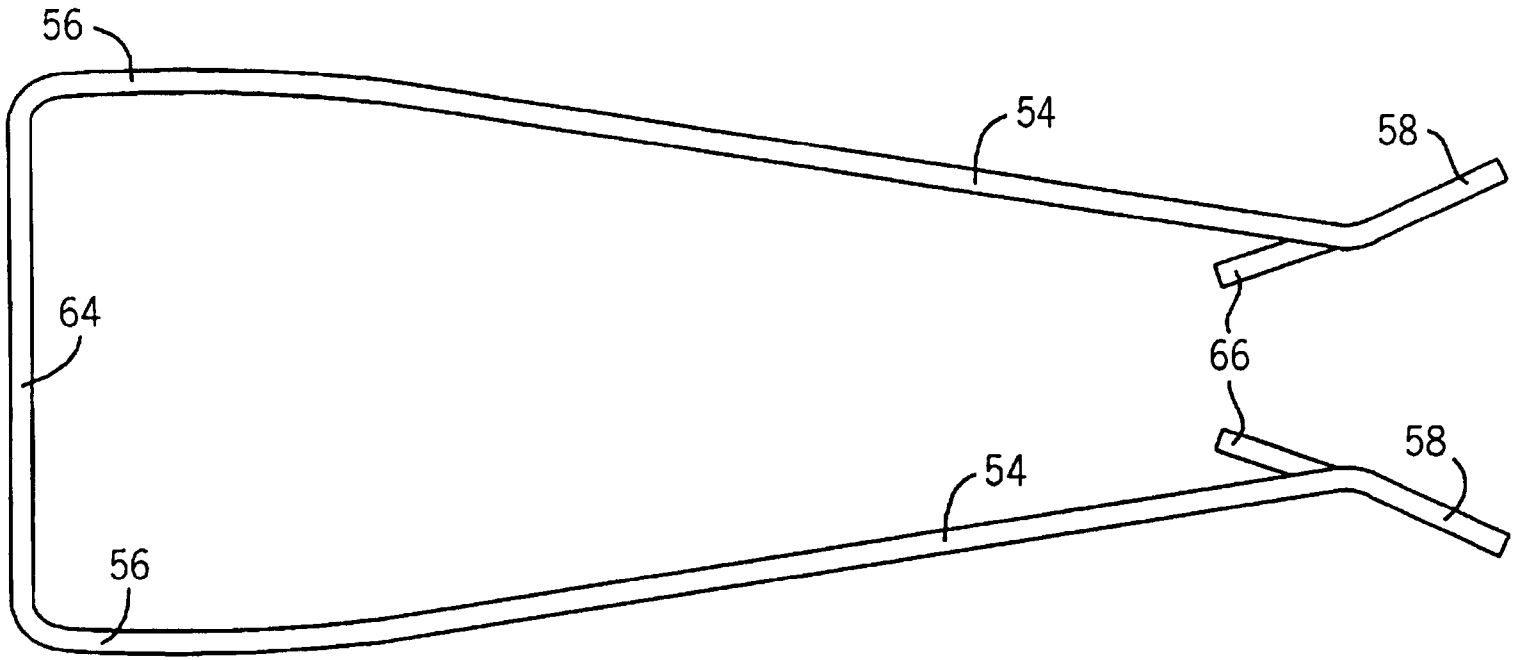
FIG. 6 is a perspective view of the latching arms of FIG. 5.

Referring to FIGS. 3–5, the body 20 is substantially rectangular, and has a top 26 and bottom 28 connected by sides 30 and ends 32, 34. A slot 36 formed in the bottom 28 and through the sides 30 receives the lever 16. Rails 38 formed on the body sides 30 engage the blocking member 24 to slidably fix the blocking member 24 thereto. A groove 40 formed in the bottom 28 proximal the rear end 34 intersects grooves 42 formed in the body sides 30 for receiving the U-shaped lever engaging member 22 formed from wire. A receptacle 44 opening to the rear end 34 intersects a key hole 46 formed through the body top 26. The key hole 46 intersects, and is coaxial with, a stop hole 48 formed through the body bottom 28 for receiving a cylindrical tether stop 50.

The receptacle 44 receives a latch member 52 extending from the blocking member 24 which engages a pair of opposing inwardly biased latching arms 54 disposed in the receptacle 44. The receptacle 44 is preferably a substantially rectangular cavity which is open to the body rear end 34 and one side 30. Advantageously, the receptacle 44 having an open side 30 simplifies molding the body 20 and assembling the lock out assembly 10. Although an open sided receptacle 44 is preferred, the receptacle 44 can be formed with two open sides or no open sides without departing from the scope of the invention.

Referring to FIGS. 5–8, the pair of opposing inwardly biased latching arms 54 are disposed in the receptacle 44, and latch onto the latch member 52. Each arm 54 has a base end 56 and a distal end 58. The base end 56 is disposed proximal the closed front end of the receptacle 44, and the distal end 58 extends toward the receptacle opening 62 at the body rear end 34. Preferably, the arms 54 are formed from a flat spring steel, and are connected at the arm base ends 56 by a connecting piece 64 to form a U-shape.

The arms 54 bow around the intersecting key hole 46, and are flared outwardly at the distal ends 58 for engagement with the latch member 52. Advantageously, when the arms 54 initially engage the latch member 52, the flared distal ends 58 force the arms 54 outwardly to receive the latch member 52 between the arms 54. When the latch member 52 is fully received in the receptacle 44, tabs 66 extending inwardly and forwardly (away from the open end of the receptacle) from the arms 54 hook the latch member 52 and prevent withdrawal of the latch member 52 from the receptacle 44. Preferably, the tabs 66 are formed as an integral part of the arms 54 to simplify the assembly of the lock out assembly 10.

The lever engaging member 22 disclosed in FIGS. 1–5 includes a pair of opposing resilient legs 68 having inwardly extending pins 70 for engagement with each end 72 of a transverse through hole 74 formed in the lever 16. The legs 68 and pins 70 are, preferably, formed as an integral piece from a U-shaped wire wrapped around a portion of the body 20, wherein each leg 68 of the U-shaped lever engaging member 22 is joined by the connecting piece 64 received in the body bottom groove 40.

Each leg 68 is received in the outwardly opening groove 42 formed in the body 20, and has a proximal end 75 and a distal end 77. The proximal end 75 of the leg 68 is proximal the body rear end 34, and the distal end 77 is biased away from the body side 30 proximal the body slot 36. The pin 70 extends inwardly toward the body slot 36 from the leg distal end 77, and moves from a disengaged position (shown in FIG. 1) to an engaged position (shown in FIG. 2) as the leg distal end 77 is urged toward the body 20 into the side groove 42 by the blocking member 24. In the engaged position, the pins 70 are inserted into the ends 72 of the lever through hole 74. In the disengaged position, the pins 70 are withdrawn from the ends 72 of the lever hole 74. Advantageously, when the pins 70 are in the engaged position, the lock out body assembly 10 cannot be easily removed from the lever 16.

Referring to FIGS. 1–5, the blocking member 24 slidably moves over the resilient lever engaging member legs 68 from the unlocked position to the locked position to urge the pins 70 from the disengaged position to the engaged position. Although movably fixing the blocking member to the body, such that the blocking member is slidable relative to the body is preferred, the blocking member can be movably fixed to the body, such that the blocking member is pivotable or rotatable relative to the body, without departing from the scope of the invention.

The blocking member 24 includes a top wall 76 and bottom wall 78 joined by side walls 80 and a rear end wall 82. The blocking member top wall 76, bottom wall 78, side walls 80, and end wall 82 define a cavity 84 which receives the rear end 34 of the body 20. A longitudinal slot 85 is formed in the blocking member top wall 76 to provide access to the key hole 46 formed in the body 20. Inwardly opening grooves 86 formed in each side wall 80 are aligned with the outwardly opening grooves 42 formed in the body sides 30. The blocking member grooves 86 receive the lever engaging member legs 68 and guide the legs 68 as the outwardly biased leg distal ends 77 are urged inwardly by the blocking member side walls 80 to move the pins 70 into engagement with the lever 16.

Inwardly opening grooves 88 formed in each blocking member side wall 80 proximal the blocking member top wall 76 engage the rails 38 extending from the body sides 30 to slidably fix the blocking member 24 to the body 20. Although inwardly opening grooves 88 for slidably fixing the blocking member 24 to the body 20 are disclosed, the blocking member 24 can be slidably fixed to the body 20 using methods known in the art, such as by forming grooves in the blocking member top wall which engage rails formed in the body top, formed grooves in the body which are engaged by lips formed in the blocking member which wrap around the rails, and the like, without departing from the scope of the invention.

Referring to FIGS. 1 and 5, the blocking member side walls 80 are substantially rectangular, and a cutout 90 formed in the forward bottom corner of each side wall 80 conforms with a portion 92 of the body slot 36 when the blocking member 24 is in the unlocked position. A notch 94 formed in the lower edge 96 of each side wall 80 is open to the cutout 90, and extends rearwardly from the cutout 90 a distance sufficient to disengage the side wall 80 from the outwardly biased distal end 77 of the engaging member leg 68 while still covering the proximal end 75 of the engaging member leg 68, such that the proximal end 75 of the engaging member leg 68 is retained in the groove 42 formed in the body 20. Although blocking member sides having a specific shape is disclosed, the sides can have any shape, or in certain embodiments, such as described below, be omitted, without departing from the scope of the invention.

Figure 7:
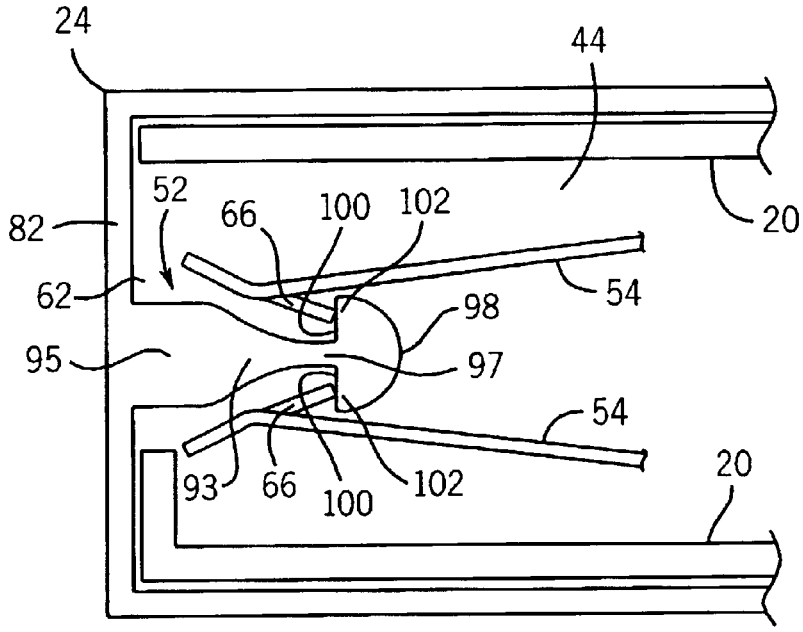
FIG. 7 is a cross sectional top view of the lock out assembly of FIG. 1 with the latch member in the lock position.
Figure 8:
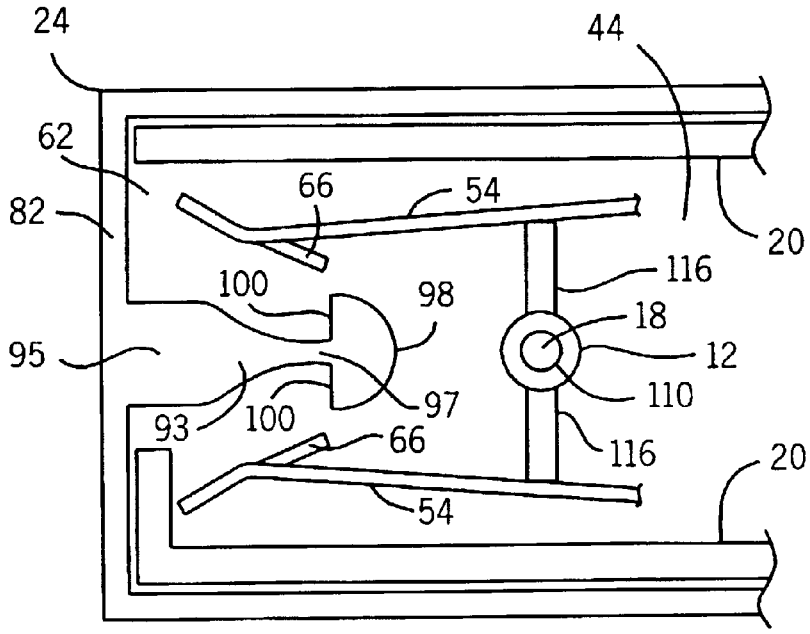
FIG. 8 is a cross sectional top view of the lock out assembly of FIG. 1 with the latch member in the unlock position.

Referring to FIGS. 7 and 8, the latch member 52 extends forwardly from the blocking member end wall 82, and is received in the body receptacle 44 to engage the latching arms 54. The latch member 52 engages the latching arms 54, and prevents the blocking member 24 from slidably moving relative to the body 20. The latch member 52 includes a stem 93 having proximal end 95 joined to the blocking member end wall 82 and a distal end 97. A head 98 joined to the distal end 97 extends laterally past the stem 93, and includes rearwardly facing surfaces 100 on the lateral portions 102 of the head 98. The rearwardly facing surfaces 100 engage the tabs 66 extending inwardly from the latching arms 54 to prevent the blocking member 24 from slidably moving relative to the body 20.

Referring back to FIG. 5, a support post 104 extending forwardly from the blocking member end wall 82 supports a biasing member 106 interposed between the blocking member 24 and body 20. The post 104 is received in an opening 108 (shown in FIG. 4) formed in the body rear end 34, and supports the biasing member 106 as it urges the blocking member 24 and body 20 apart. Preferably, the post 104 and latch member 52 are formed as an integral part of the blocking member end wall 82. However, the post 104 and latch member 52 can be formed independently of the blocking member 24 and fixed thereto using other methods known in the art, such as fasteners, adhesives, and the like, without departing from the scope of the invention.

The biasing member 106 interposed between the blocking member 24 and body 20 biases the blocking member 24 away from the body 20. In the embodiment disclosed herein, the biasing member 106 is a helical spring having one end 107 engaging the body rear end 34 and an opposing end 109 engaging the blocking member end wall 82. Advantageously, when the blocking member 24 is in the lock position, the biasing member 106 maintains the latching arms 54 in positive engagement with the latch member 52. Although a single helical spring is preferred, other biasing members can be used, such as multiple helical springs, leaf springs, elastomeric materials, and the like, or the biasing member can be omitted, without departing from the scope of the invention.

Referring to FIGS. 1, 5, 7, and 8, the key 12 is received in the key hole 46 formed in the body 20, and engages the latching arms 54 to disengage the latching arms 54 from the latch member 52. An axial passageway 110 is formed through the key 12 between a key head end 112 and toe end 114, and the tether 18 is routed through the passageway 110 to slidably fix the key 12 to the tether 18. The key toe end 114 includes a pair of opposing radially extending teeth 116 which engage the latching arms 54 when the toe end 114 is received in the key hole 46 to disengage the latching arms 54 from the latch member 52. Rotation of the key 12 about a key cylindrical axis 118 engages the teeth 116 with the latching arms 54 to spread the latching arms 54 apart and disengage the tabs 66 from the latch member 52. Wings 120 radially extending from the cylindrical key 12 midway between the head end 112 and toe end 114 can be provided to provide engagement surfaces for a user's fingers to rotate the key 12 about the key cylindrical axis 118.

As shown in FIGS. 1, 3, and 5, a key guide 128 having a cylindrical neck 130 extending upwardly through the key hole 46 includes an axial passageway 132. The tether 18 passes through the axial passageway 132, and the key 12 slips over the neck 130 which guides the key 12 into the key hole 46 for engagement with the latching arms 54. The key guide 128 is preferably formed from a metal, such as aluminum, and is held in the key hole 46 using a friction fit. Other methods for rigidly fixing the guide 128 in the key hole 46 can be used, such as molding the body around the guide, adhesives, and the like without departing from the scope of the invention. Advantageously, the key guide 128 reduces the open area of the key hole 46, and prevents an unauthorized user from inserting a sharp object into the key hole 46 to manipulate the latching arms 54 and disengage the latching arms 54 from the latch member 52. Although a metal key guide, as disclosed, is preferred, the key guide can be modified or omitted without departing from the scope of the invention.

Figure 9:
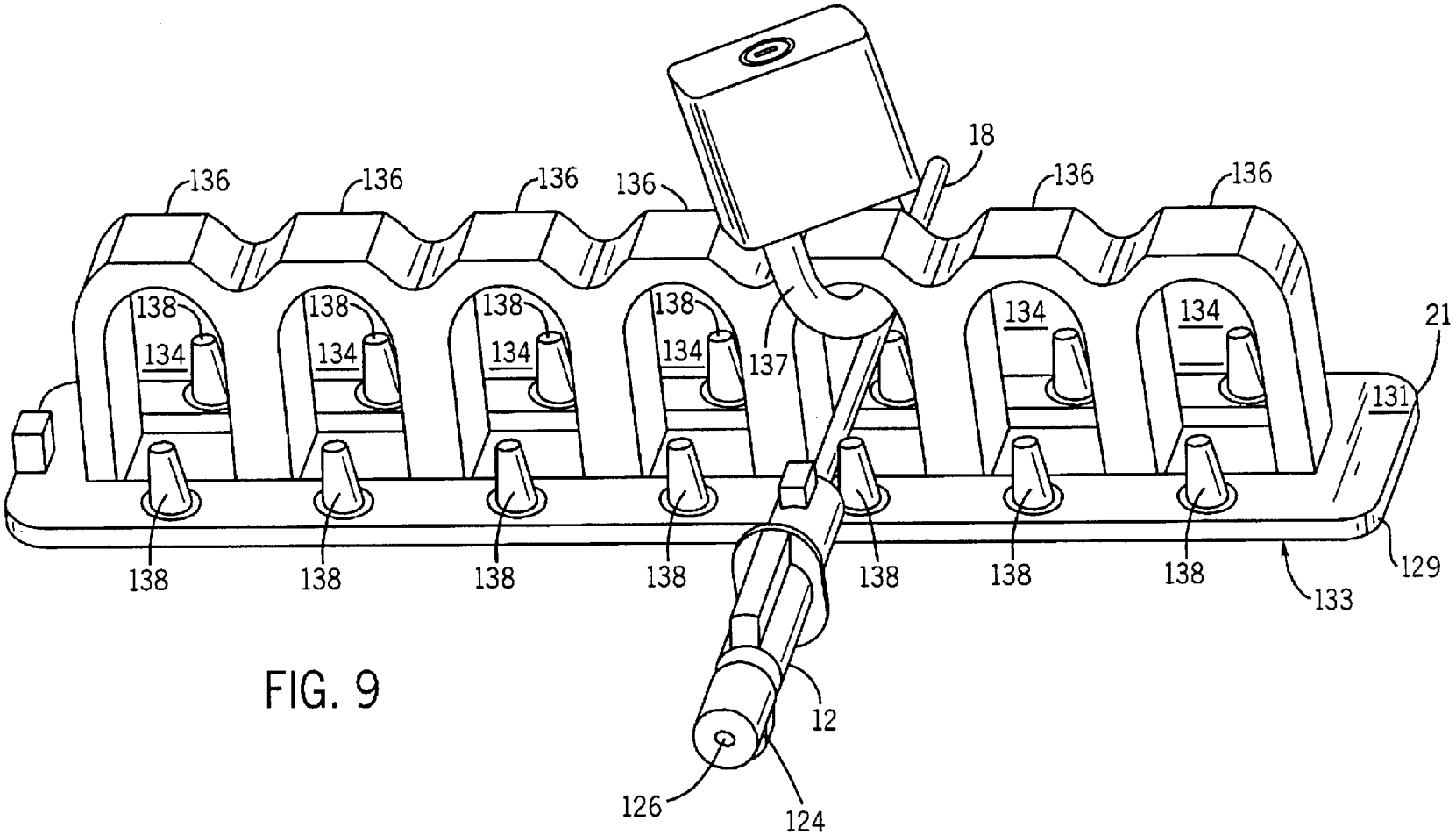
FIG. 9 is a top perspective view of a lock rail for use with the lock out assembly of FIG. 1.
Figure 10:
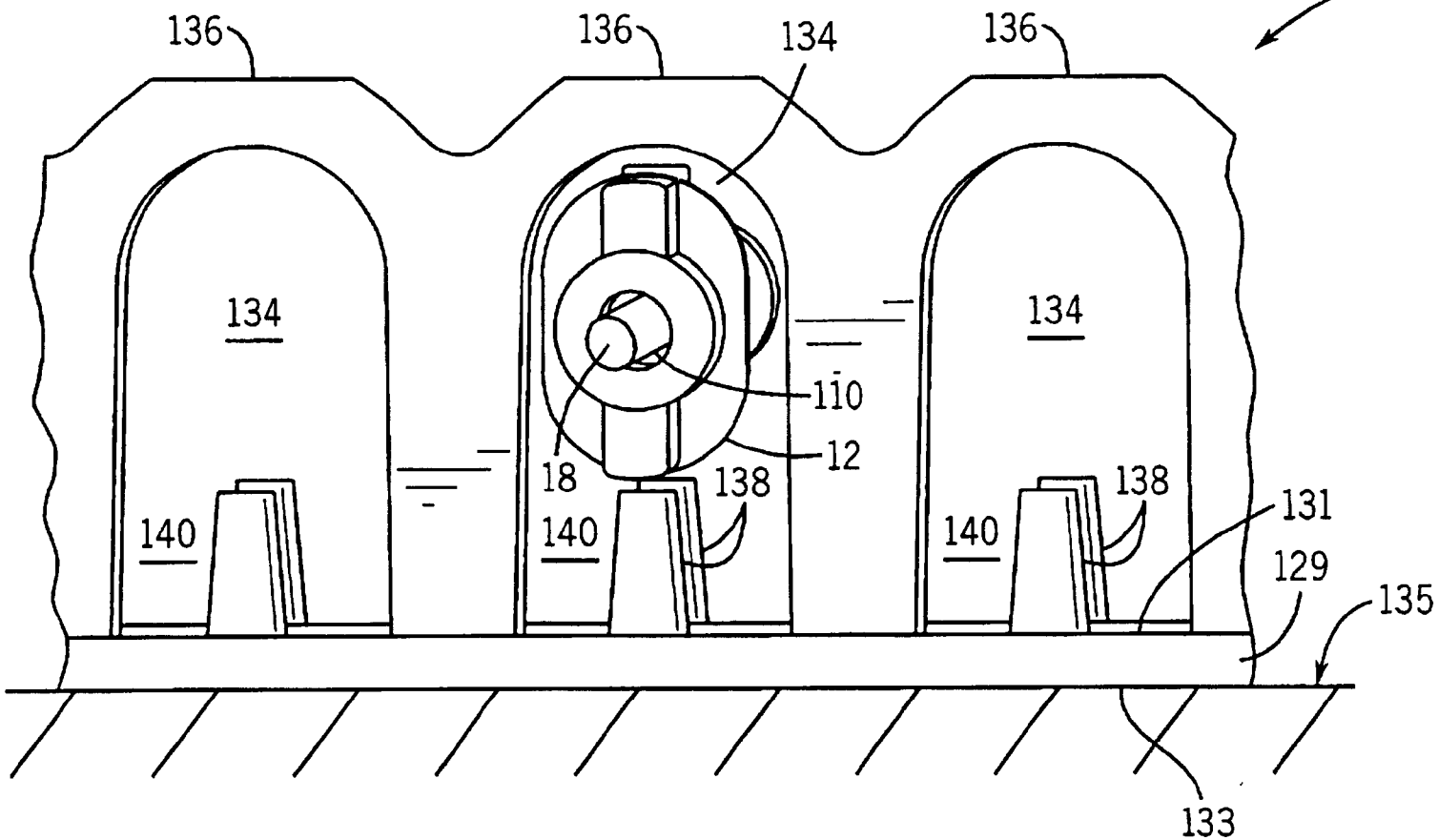
FIG. 10 is a front perspective view of the lock rail of FIG. 9.

Referring to FIGS. 5, 9, and 10, the tether 18 is preferably a multistrand metal cable, and passes through the axial passageway 110 in the key 12, the slot 85 formed in the blocking member 24, and the key hole 46 formed in the body 20 between the latching arms 54. One end 122 of the tether 18 is anchored to the body 20 by the cylindrical stop 50 fixed onto the tether end 122. The stop 50 is received in the stop hole 40 which has a diameter that is greater than the diameter of the key hole 46 to prevent the stop 50 from passing through the key hole 46. A second stop 124 (shown in FIG. 9) fixed to the free end 126 of the tether 18 prevents the tether 18 from slipping out of the key passageway 110. The stops 50, 124 can be fixed to the respective tether ends 122, 126 using methods known in the art, such as molding, crimping, soldering, adhesives, friction fits, and the like without departing from the scope of the invention.

Referring now to FIGS. 9 and 10, the free end 126 of the tether 18 is locked to the lock rail 21 to prevent unauthorized use of the key 12. The lock rail 21 is fixed adjacent to a surface 135 within an area defined by the length of the tether 18. The lock rail 21 has a base 129 including a top 131 and a bottom 133, and is fixed to the surface 135, such as a surface of the circuit breaker box, panel, and the like, in proximity to the circuit breaker 14 (shown in FIG. 1). The base 129 can be fixed to the surface 135, using methods known in the art, such as by an adhesive applied to the base bottom 133, screws extending through the base 129, and the like.

A plurality of arches 136 extend from the base top 131, and define a plurality of transverse openings 134 above the base 129. Preferably, the arches 136 are formed as an integral part of the base 129. Although arches 136 are described herein, other structures can be provided to form openings 134 above or in the base 129 for receiving the key 12 therethrough, such as open ended boxes, through bores formed in the base 129, a clamp structure which pivots away from the base 129, and the like, without departing from the scope of the present invention.

Pins 138 extend upwardly from the base top 131 in front of and behind each opening 134 to block the lower portion 140 of the opening 134. The pins 138 prevent transverse movement of the key 12 through the lower portion 140 of the opening 134. Preferably, each opening 134 is sized such that the key 12 can be slipped into the opening 134 above the pins 138, and the tether 18 can be pressed downwardly into the lower portion 140 of the opening 134 adjacent to the pins 138. A lock hasp 137 can be slipped through the opening 134 above the pins 138 to prevent passage of the key 12 through the opening 134 above the pins 138.

Referring to FIGS. 1–10, in use, the circuit breaker lock out assembly 10 is locked onto the lever 16 by slipping the lever 16 into the lock out head body slot 36, and aligning the lever engaging member pins 70 with each end 72 of the hole 74 formed in the lever 16. An unauthorized user is prevented from disengaging the lock out assembly 10 from the lever 16 by sliding the blocking member 24 forwardly to urge the pins 70 into the hole ends 72 until the latch member 52 is fully engaged with the latching arms 54. Once the circuit breaker lock out assembly 10 is locked onto the lever 16 and the blocking member 24 is in the locked position, the key 12 is slipped through one of the openings 134 in the lock rail 21, and the lock hasp 137 is slipped through the opening 134 and locked in place to prevent unauthorized removal of the key 12.

The circuit breaker lock out assembly 10 is disengaged from the lever 16 by first unlocking the lock hasp 137, and removing the hasp 137 from the lock rail opening 134. The key 12 is slipped through the lock rail opening 134 along the tether 18, and inserted into the key hole 46 over the key guide neck 130. Once the key toe end 114 is fully inserted into the key hole 46 such that the key teeth 116 are aligned between the latching arms 54, the key 12 is rotated about the key axis 118 to engage the teeth 116 with the latching arms 54 and urge the latching arms 54 outwardly away from the latch member 52. This causes the latch arm tabs 66 to disengage from the latch member 52.

Once the arm tabs 66 are disengaged from the latch member 52, the biasing member 106 urges the blocking member 24 rearwardly to uncover the lever engaging member legs distal ends 77. The outwardly biased distal ends 77 of the lever engaging member 22 spring outwardly to disengage the pins 70 from the lever hole ends 72, and release the lever 16, such that the lever 16 can be slipped out of the lock out head body slot 36.

Figure 11:
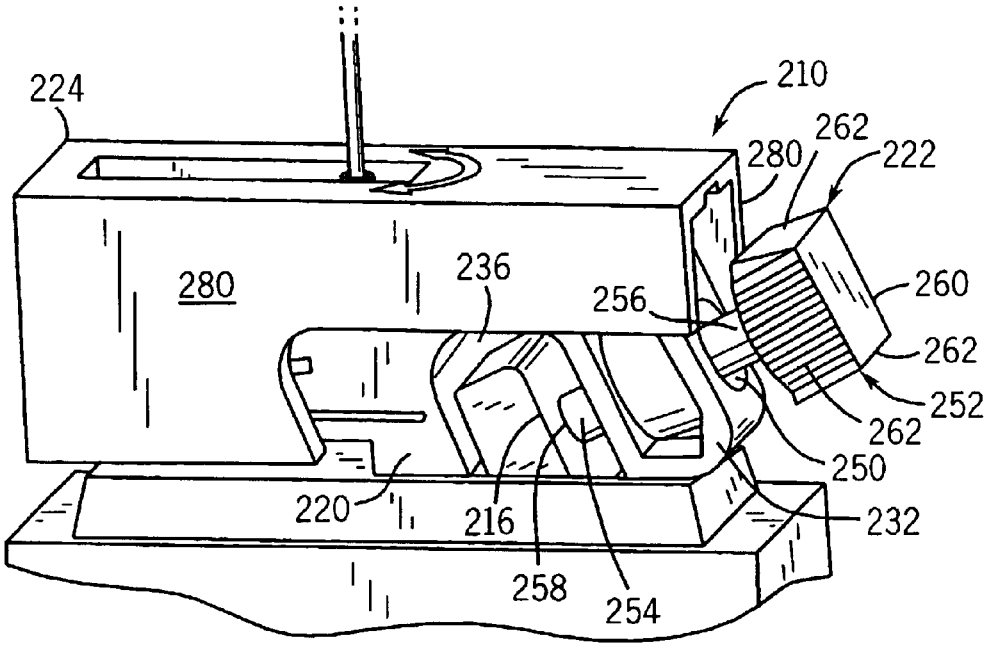
FIG. 11 is a perspective view of an alternative lock out assembly incorporating the present invention.
Figure 13:
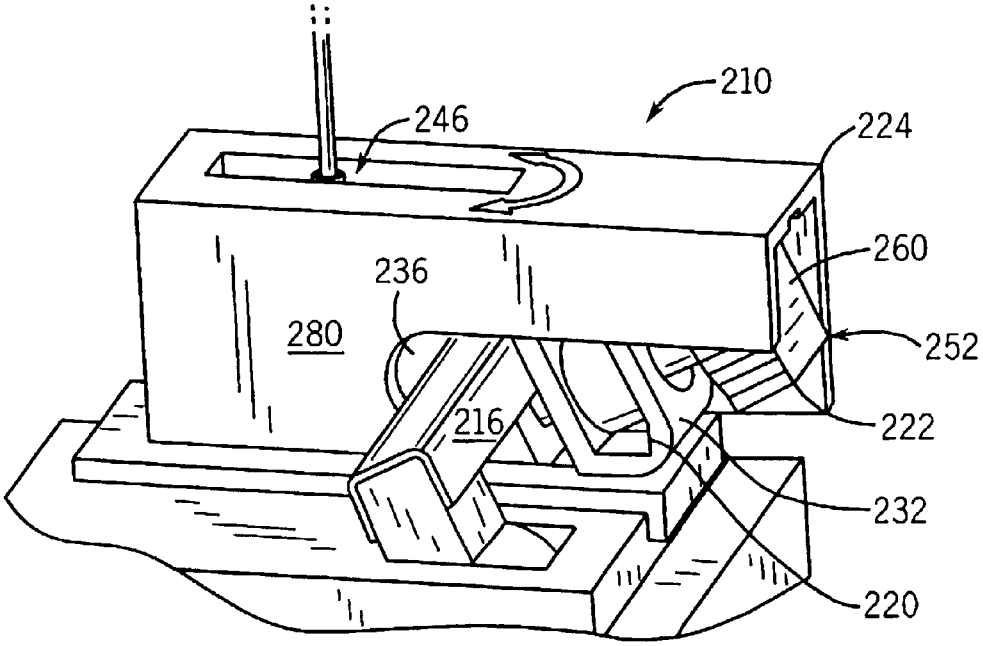
FIG. 13 is a perspective view of the lock out assembly of FIG. 11 clamped onto a multipole circuit breaker.
Figure 12:
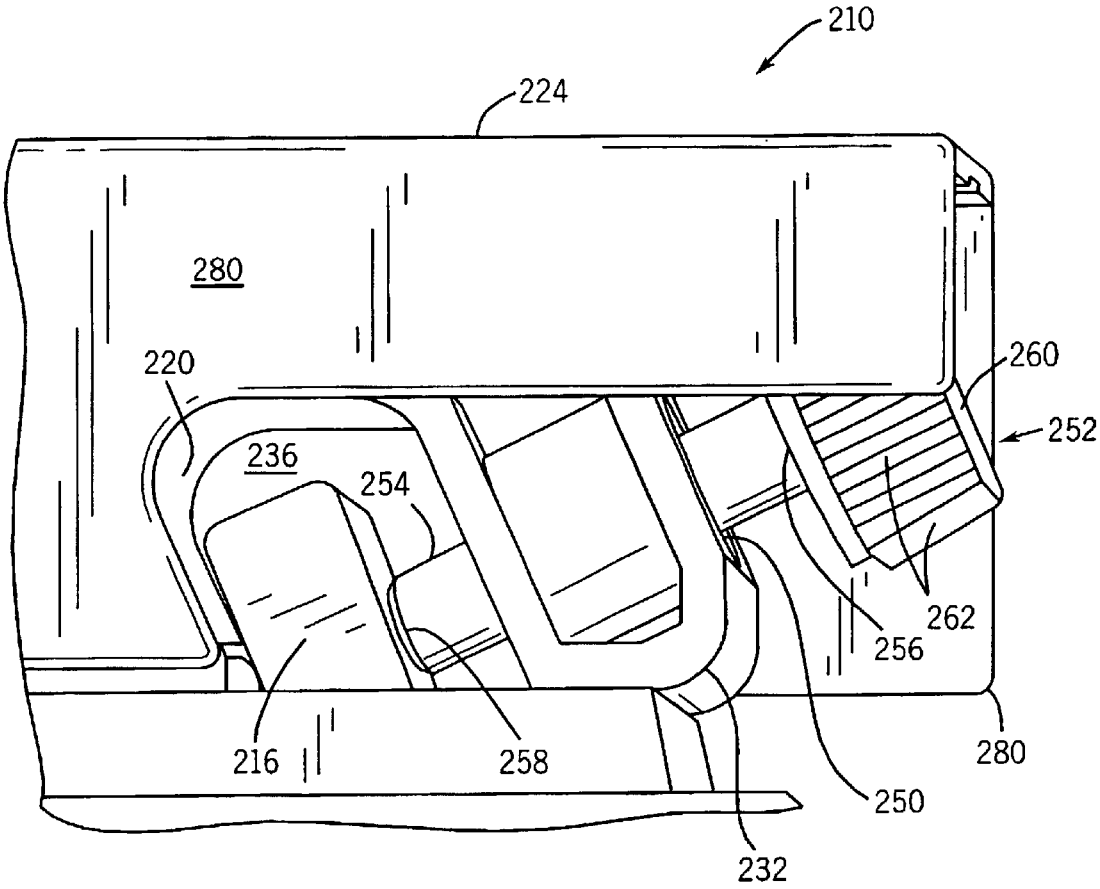
FIG. 12 is a perspective view of the lock out assembly of FIG. 11 with the blocking member in the lock position.

In a second embodiment shown in FIGS. 11–13, a lock out assembly 210 includes a threaded bore 250 formed through the front end 232 of the body 220 which intersects the body slot 236 for receiving the lever 216. Although a threaded bore 250 is disclosed, an internally threaded insert can be fixed in the body 220 using methods known in the art, such as by molding the insert into the body, slipping the insert into an unthreaded bore and adhesively fixing the insert in the bore, and the like without departing from the scope of the invention. The bore 250 threadably engages the lever engaging member 222 to clamp the lock out assembly 210 to the lever 216.

The lever engaging member 222 shown in FIGS. 11–13 is a thumbwheel 252 including a threaded post 254 having a head end 256 and a lever engaging end 258. The threaded post 254 threadably engages the threaded bore 250 to axially move the post 254 through the bore 250 between an engaged position and a disengaged position. In the engaged position, the substantially flat lever engaging end 258 engages the lever 216 extending into the body slot 236 to clamp the lever 216 against the body 220, and thus clamp the assembly 210 onto the lever 216. Although, the lever engaging end 258 shown in FIGS. 11–13 is substantially flat, the lever engaging end 258 can have any shape, such as a cup form, a pointed form, a flat form, and the like, for engaging the lever 216 without departing from the scope of the invention.

A thumbwheel head 260 fixed to the thumbwheel head end 256 is square to include flat surfaces 262 which fit between blocking member side walls 280 when the blocking member 224 is in the locked position. Although any shaped thumbwheel head 260 can be used, a head having at least one flat surface which can engage the blocking member in the locked position is preferred to prevent rotation of the thumbwheel when the blocking member is in the locked position.

The blocking member 224 slidably moves over the thumbwheel head 260 from the unlocked position (shown in FIG. 11) to the locked position (shown in FIG. 13) to prevent disengagement of the lock out assembly 210 from the lever 216. In the embodiment disclosed herein, the blocking member 224 covers the thumbwheel head 260 to prevent access thereto. Advantageously, the blocking member 224 disclosed herein also engages the thumbwheel head flat surfaces 262 to prevent rotation of the thumbwheel head 260. The blocking member 224 is locked in the lock position using latching arms and a latch member, as described above, wherein a key is required to disengage the latching arms from the latch member. Advantageously, as shown in FIG. 13, the circuit breaker lock out assembly 210 having a thumbwheel lever engaging member 222 can accommodate a lever 216 which does not fit between the blocking member side walls 280.

In use, the circuit breaker lock out assembly 210 is clamped onto the lever 216 by slipping the lever 216 into the lock out head body slot 236, and rotating the thumbwheel 252 to engage the thumbwheel lever engaging end 258 with the lever 216 until the lever 216 is sandwiched between the thumbwheel lever engaging end 258 and the body 220. An unauthorized user is prevented from disengaging the lock out assembly 210 by aligning the flat surfaces 262 of the thumbwheel head 260 with the blocking member side walls 280, and sliding the blocking member 224 forwardly toward the locked position over the thumbwheel head 260 until the latch member is fully engaged with the latching arms, as described above in the first embodiment. Once the circuit breaker lock out assembly 210 is clamped onto the lever 216 and the blocking member 224 is in the locked position, the key can be locked to a lock rail, as described above in the first embodiment.

The circuit breaker lock out assembly 210 is disengaged from the lever 216 by retrieving the key and inserting it into the into the key hole 246 such that the key teeth are aligned between the latching arms. As described above, the key is rotated to urge the latching arms outwardly away from the latch member and disengage the latch member. As shown in FIG. 11, the blocking member 224 is moved rearwardly to the unlock position to uncover the thumbwheel head 260. The thumbwheel 252 is then rotated to disengage the thumbwheel lever engaging end 258 from the lever 216, such that the lever 216 can be slipped out of the lock out head body slot 236.

Figure 14:
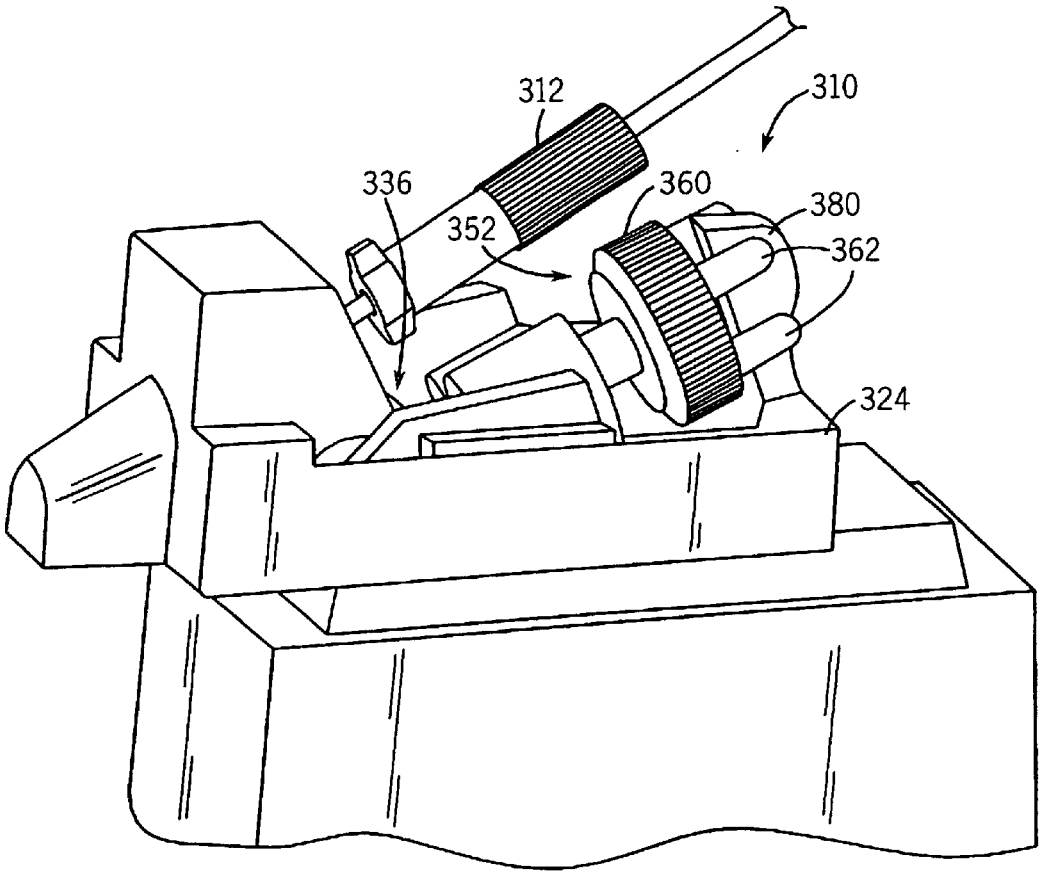
FIG. 14 is a perspective view of another alternative lock out assembly incorporating the present invention.
Figure 15:
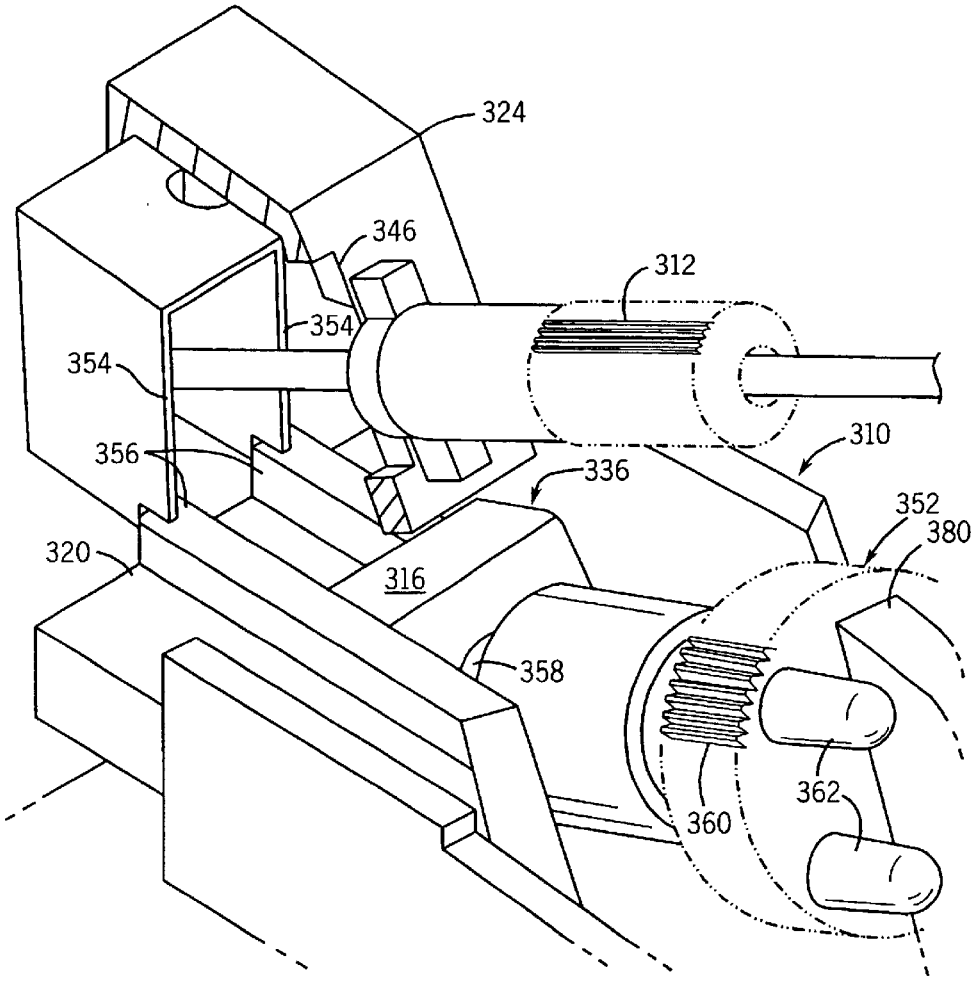
FIG. 15 is a top perspective cut away view of the lock out assembly of FIG. 14.

In a third embodiment shown in FIGS. 14 and 15, a lock out assembly 310 includes lock posts 362 which extends axially from a thumbwheel head 360 of a thumbwheel 352. The posts 362 engage a frame lock plate 380 extending upwardly from the slidable blocking member 324. When the blocking member 324 is in the lock position, as shown in FIGS. 14 and 15, the lock plate 380 engages the lock posts 362 and prevents rotation of the thumbwheel 352. In the unlock position, the lock posts 362 are not engaged with the lock plate 380 and allow rotation of the thumbwheel 352. As shown in FIG. 15, in this embodiment, latching arms 354 are fixed to the blocking member 324, and the latch member 356 forms part of the body 320.

In use, the circuit breaker lock out assembly 310 is clamped onto the lever 316 by slipping the lever 316 into the lock out head body slot 336, and rotating the thumbwheel 352 to engage the thumbwheel lever engaging end 358 with the lever 316 until the lever 316 is sandwiched between the thumbwheel lever engaging end 358 and the body 320. An unauthorized user is prevented from disengaging the lock head by sliding the blocking member 324 rearwardly toward the locked position and slipping the lock plate 380 between the posts 362 until the latch member 356 is fully engaged with the latching arms 354. Once the circuit breaker lock out assembly 310 is clamped onto the lever 316 and the blocking member 324 is in the locked position, the key 312 can be locked to a lock rail, as described above.

The circuit breaker lock out assembly 310 is disengaged from the lever 316 by first retrieving the key 312, and inserting the key 312 into the key hole 346 such that the key teeth are aligned between the latching arms 354. The key 312 is rotated to urge the latching arms 354 outwardly away from the latch member 356, and disengage the latching arms 354 from the latch member 356. The blocking member 324 is slid forwardly to disengage the lock plate 380 from the lock posts 362 to allow rotation of the thumbwheel 352. The thumbwheel 352 is then rotated to disengage the thumbwheel lever engaging end 358 from the lever 316, such that the lever 316 can be slipped out of the lock out head body slot 336.

While there has been shown and described what are at present considered the preferred embodiments of the invention, it will be obvious to those skilled in the art that various changes and modifications can be made therein without departing from the scope of the invention defined by the appended claims.

I claim:

1. A switch lever lock out assembly engagable with a switch, said assembly comprising:

a lock out body engageable with a switch to prevent operation of the switch;

a lever engaging member mounted to said body and having a lock position and an unlock position, wherein in said lock position said lever engaging member prevents disengaging said body from the switch;

a blocking member movably fixed to said body and engageable with said lever engaging member to prevent movement of said lever engaging member relative to said body when said lever engaging member is in said lock position;

a latch member fixed relative to one of said body and said blocking member;

a latching member engagable with said latch member in an engaged position, and fixed relative to the other of said body and said blocking member, wherein in said engaged position, said blocking member is locked relative to said lever engaging member in the lock position; and a key engageable with at least one of said latch member and said latching member to disengage said latching member from said latch member and allow said blocking member to move relative to said body to allow said lever engaging member to move from said lock position to said unlock position.

2. The lock out assembly as in claim 1, in which said latching member includes at least one resilient arm fixed to one of said lock out body and said blocking member, said at least one arm engages said latch member fixed to the other of said lock out body and blocking member to lock said blocking member relative to said lever engaging member.

3. The lock out assembly as in claim 1, including a tether having a first end and a second end, said first end being fixed to at least one of said body and said blocking member, and said key is slidably fixed to said tether for slidable movement between said first and second ends.

4. The lock out assembly as in claim 3, in which said tether is a wire cable.

5. The lock out assembly as in claim 3, in which said second end extends through a lock rail fixed remote from said body, wherein said lock rail includes at least one opening that can receive a lock which locks said second end to said lock rail to prevent engaging said key with said locking member when said key is adjacent said second end.

6. The lock out assembly as in claim 1, in which said lever engaging member is a thumbwheel threadably engaging said body, wherein said thumbwheel is engageable with the switch to lamp the switch against said body.

7. The lock out assembly as in claim 1, in which said lever engaging member includes at least one pin extending into a hole formed in the switch.

8. The lock out assembly as in claim 1, in which said latch member is formed as an integral part of one of said body and said blocking member.

9. The lock out assembly as in claim 1, in which a key guide disposed in a key hole formed in at least one of said body and said blocking member engages said key to guide said key in said key hole.

10. A switch lever lock out assembly engagable with a switch, said assembly comprising:

a switch lever lock out mechanism engageable with a switch to prevent operation of the switch, and having a key engageable lock which is lockable to prevent disengagement of said mechanism from the switch;

a key engageable with said key engageable lock for unlocking said key engageable lock and allowing disengagement of said mechanism from the switch; and a tether having a first end and a second end, said first end being fixed to said mechanism, and said key is slidably fixed to said tether for slidable movement between said first and second ends.

11. The lock out assembly as in claim 10, in which said tether is a wire cable.

12. The lock out assembly as in claim 10, including a lock rail fixed remote from said mechanism wherein said second end extends through an opening formed in said lock rail, and said opening can receive a lock which locks said second end to said lock rail to prevent engaging said key with said key engageable lock when said key is adjacent said second end.

13. The lock out assembly as in claim 10 in which said key engageable lock includes a lever engaging member mounted to said body and having a lock position and an unlock position, wherein in said lock position said lever engaging member prevents disengaging said body from the switch, a blocking member movably fixed to said body and engageable with said lever engaging member to prevent movement of said lever engaging member relative to said body when said lever engaging member is in said lock position, a latch member fixed relative to one of said body and said blocking member, a latching member engagable with said latch member in an engaged position, and fixed relative to the other of said body and said blocking member, wherein in said engaged position, said blocking member is locked relative to said lever engaging member in the lock position, wherein said key is engageable with at least one of said latch member and said latching member to disengage said latching member from said latch member and allow said blocking member to move relative to said body to allow said lever engaging member to move from said lock position to said unlock position.

14. The lock out assembly as in claim 13, in which said latching member includes at least one resilient latching arm fixed to one of said lock out body and said blocking member, said at least one latching arm engages said latch member fixed to the other of said lock out body and blocking member to lock said blocking member relative to said lever engaging member.

15. The lock out assembly as in claim 13, in which said lever engaging member is a thumbwheel threadably engaging said body, wherein said thumbwheel is engageable with the switch to clamp the switch against said body.

16. The lock out assembly as in claim 13, in which said lever engaging member includes at least one pin extending into a hole formed in the switch.

17. The lock out assembly as in claim 13, in which said latch member is formed as an integral part of one of said body and said blocking member.

18. The lock out assembly as in claim 10, in which a key guide disposed in a key hole formed in said mechanism engages said key to guide said key in said key hole.

19. A switch lever lock out assembly engagable with a switch, said assembly comprising:

a lock out body engageable with a switch to prevent operation of the switch;

a lever engaging member mounted to said body and having a lock position and an unlock position, wherein in said lock position said lever engaging member prevents disengaging said body from the switch;

a blocking member slidably fixed to said body and engageable with said lever engaging member to prevent movement of said lever engaging member relative to said body when said lever engaging member is in said lock position;

a latch member fixed relative to one of said body and said blocking member;

a latching member engagable with said latch member in an engaged position, and fixed relative to the other of said body and said blocking member, wherein in said engaged position, said blocking member is locked relative to said lever engaging member in the lock position;

a key engageable with at least one of said latch member and said latching member to disengage said latching member from said latch member and allow said blocking member to move relative to said body to allow said lever engaging member to move from said lock position to said unlock position;

a tether having a first end and a second end, said first end being fixed to at least one of said body and said blocking member, and said key is slidably fixed to said tether for slidable movement between said first and second ends; and a lock rail fixed remote from said body, wherein said second end extends through an opening formed in said lock rail, and said opening can receive a lock which locks said second end to said lock rail to prevent engaging said key with said key engageable lock when said key is adjacent said second end.

20. The lock out assembly as in claim 19, in which a key guide disposed in a key hole formed in at least one of said body and said blocking member engages said key to guide said key in said key hole.

* * * * *

UNITED STATES PATENT AND TRADEMARK OFFICE

CERTIFICATE OF CORRECTION

PATENT NO. : 6,727,441 B2
DATED : April 27, 2004
INVENTOR(S) : Benda

It is certified that error appears in the above-identified patent and that said Letters Patent is hereby corrected as shown below:

Column 10,
Line 40, “lamp” should be -- clamp --

Signed and Sealed this

Seventh Day of December, 2004

JON W. DUDAS
*Director of the United States Patent and Trademark Office*